US007041015B2

(12) United States Patent
Sowders

(10) Patent No.: US 7,041,015 B2
(45) Date of Patent: May 9, 2006

(54) BASKETBALL SHOOTING AID

(76) Inventor: Troy S. Sowders, 517 S. Willow Rd., Evansville, Vanderburgh County, IN (US)

( * ) Notice: Subject to any disclaimer, the term of this patent is extended or adjusted under 35 U.S.C. 154(b) by 0 days.

(21) Appl. No.: 10/396,210

(22) Filed: Mar. 24, 2003

(65) Prior Publication Data

US 2003/0181266 A1 Sep. 25, 2003

Related U.S. Application Data

(60) Provisional application No. 60/367,047, filed on Mar. 25, 2002.

(51) Int. Cl.
*A63B 69/00* (2006.01)
*A63B 43/00* (2006.01)

(52) U.S. Cl. ..... 473/422; 473/447; D21/714; 40/327; 434/248

(58) Field of Classification Search ..... 473/422, 473/447, 448, 569, 593, 604, 596, 597; 434/247, 434/248, 257; 40/327; D21/714, 713
See application file for complete search history.

(56) References Cited

U.S. PATENT DOCUMENTS 2,504,650 A * 4/1950 Chessrown ..... 434/172
3,858,876 A * 1/1975 Williams ..... 473/450
3,863,923 A * 2/1975 Anderson ..... 473/604
4,546,975 A * 10/1985 Nims ..... 473/447
4,570,931 A * 2/1986 Martin ..... 473/596
D329,674 S * 9/1992 Williams ..... D21/714
5,165,685 A * 11/1992 Hynes ..... 473/597
5,427,372 A * 6/1995 Ratner et al. ..... 156/147
D478,641 S * 8/2003 Kuehne ..... D21/713
D485,590 S * 1/2004 Poegel, Jr. ..... D21/714

FOREIGN PATENT DOCUMENTS

WO WO 9816279 A1 * 4/1998

* cited by examiner

*Primary Examiner*—Mitra Aryanpour
(74) *Attorney, Agent, or Firm*—Gary K. Price, Esq.

(57) ABSTRACT

A basketball shooting aid having visually distinctive designs, configurations and colors for the purpose of sending immediate visual feedback to the athlete, informing the athlete whether the proper technique was employed in the athlete's grip of the basketball, the athlete's release of the shot and the arc and rotation of the basketball during flight. An equatorial track is disposed between a first and second lines defining a first hemispherical half and a second hemispherical half, and the equatorial track further including alternating color members displayed thereon. The basketball shooting aid including a first patch displayed within the first hemispherical half abutting the first line, and a second patch displayed within the second hemispherical half abutting the second line, wherein the first patch and the second patch are on the same axis. For proper gripping of the basketball shooting aid, a first and second outlined hand are displayed.

4 Claims, 9 Drawing Sheets

BASKETBALL SHOOTING AID

CROSS REFERENCES TO RELATED APPLICATIONS

U.S. Provisional Application for Patent 60/367,047, filed Mar. 25, 2002, with title, "Basketball Shooting Aid" which is hereby incorporated by reference. Applicant claims priority pursuant to 35 U.S.C. par. 119(e)(I).

Statement as to rights to inventions made under Federally sponsored research and development Not Applicable.

BACKGROUND OF THE INVENTION

1. Field of the Invention

The present invention relates to a novel system and method for use in basketball shooting practice and, more particular, pertains to a basketball having distinctive surface configurations, designs and colors that visually provides an athlete with immediate feedback as to whether each shot was properly executed.

2. Brief Description of Prior Art

Basketball is a common sport among youths and adults alike. Most youth basketball players develop and practice their shooting techniques without instruction or a coach. Basketball is often played with a minimum of equipment, no officiating, no coaching and a makeshift court. For example, basketball is often played on a driveway or in a school yard. Basketball may also be played as a solo practice event or one-on-one between friends. Among such play, information or techniques are often erroneous. Thus, any skills developed in reliance on informal play are questionable. In fact, practice of those skills may simply solidify poor techniques.

Athletes, especially young athletes first learning the game of basketball, and particularly proper techniques of shooting the basketball, need knowledge of what to do; and, need feedback, preferably immediate feedback, as to whether the proper technique was employed for each shot. Many athletes begin shooting without supervision and adopt an unorthodox style. They need to know proper techniques. They also need some way to know whether they are executing the techniques properly during practice. Finally, athletes need a reminder with each shot, until the proper technique, properly executed is a habit.

Practicing to acquire a skill is most effective if a proper technique is properly executed numerous times. Among other things, practice strengthens required or useful muscles. Practice also creates control. However, practicing a wrong technique or executing a technique improperly teaches wrong technique and is counter-productive. In fact, bad practice may be worse than no practice. Poor practice limits an athlete's ability to perform or to improve in any sport or activity. Practice should employ proper technique for each basketball shot.

There have been many "how-to" books and manuals written about learning how to play the game of basketball and proper form and technique in shooting the basketball. However, such writings fail to include means for ensuring that the technique employed by the athlete is proper and consistent with the writings' instructions. When shooting the basketball, in order to control the shot with repeated, identical, correct, and habitual positioning and movement, immediate feedback is needed for the athlete to be aware of whether the ball's flight and rotation is proper. Such feedback immediately informs the athlete as to whether the shooting technique was properly executed. With proper technique, properly executed, the technique becomes habit, even reflex.

The use of basketballs with surface configurations of various designs, configurations and colors is also known in the prior art. More specifically, balls with surface configurations of various designs and configurations heretofore devised and utilized for the purpose of marking balls were primarily used for rendering the ball's surface more grippable through various methods and apparatus known to consist basically of familiar, expected, and obvious structural configurations. Such design and configurations were not used to provide the athlete with immediate visual feedback as to whether each shot was properly executed.

While these prior art devices fulfill their respective, particular objectives and requirements, the aforementioned patents do not describe a basketball shooting aid having distinctive surface configurations, designs and colors on the surface of the basketball to immediately inform the athlete with visual feedback as to whether proper technique was employed for each shot.

In this respect, the basketball shooting aid according to the present invention substantially departs from the conventional concepts and designs of the prior art, and in doing so provides a basketball shooting aid primarily developed for the purpose of providing the athlete immediate visual feedback as to whether the proper technique was employed for each shot. Specifically, the basketball shooting aid of the present invention visually informs the athlete as to the proper grip, the release of the shot and the arc and rotation of the basketball during flight.

It can, therefore, be appreciated that there exists a continuing need for a new and improved basketball shooting aid which can be used for providing immediate visual feedback as to whether the proper technique was employed for each shot. In this regard, the present invention substantially fulfills this need.

SUMMARY OF THE INVENTION

In view of the foregoing disadvantages inherent in the known types of basketballs with surface configurations of various designs and configurations now present in the prior art, the present invention provides an improved basketball shooting aid. As such, the general purpose of the present invention, which will be described subsequently in greater detail, is to provide a new and improved basketball shooting aid that provides immediate visual feedback to the athlete after each shot. Specifically, the basketball shooting aid of the present invention visually informs the athlete as to the proper grip, the release of the shot and the arc and rotation of the basketball during flight.

There have been many "how-to" books and manuals written about learning to play the game of basketball (hereinafter referred to as the "Manuals"). Manuals generally include proper form and techniques for shooting the basketball. While these Manuals discuss the crucial elements of the basketball shot, namely the grip, the release and the arc on the shot, and further discuss the proper techniques to properly perform these elements, they generally do not give the athlete immediate feedback as to whether the shot was properly executed, and consistent with the Manual's instructions.

The present invention is designed to provide immediate visual feedback to the athlete after each shot. Such feedback will immediately inform the athlete visually as to whether the proper technique was employed in the athlete's grip of the basketball, the athlete's release of the shot and the arc and rotation of the basketball during flight. To attain this, the present invention essentially comprises a new and improved basketball shooting aid having surface configurations of various designs, configurations and colors. The designs, configurations and colors for the purpose of sending immediate feedback to the athlete as to whether the shot was executed properly.

DESCRIPTION OF THE PREFERRED EMBODIMENT

Figure 1:
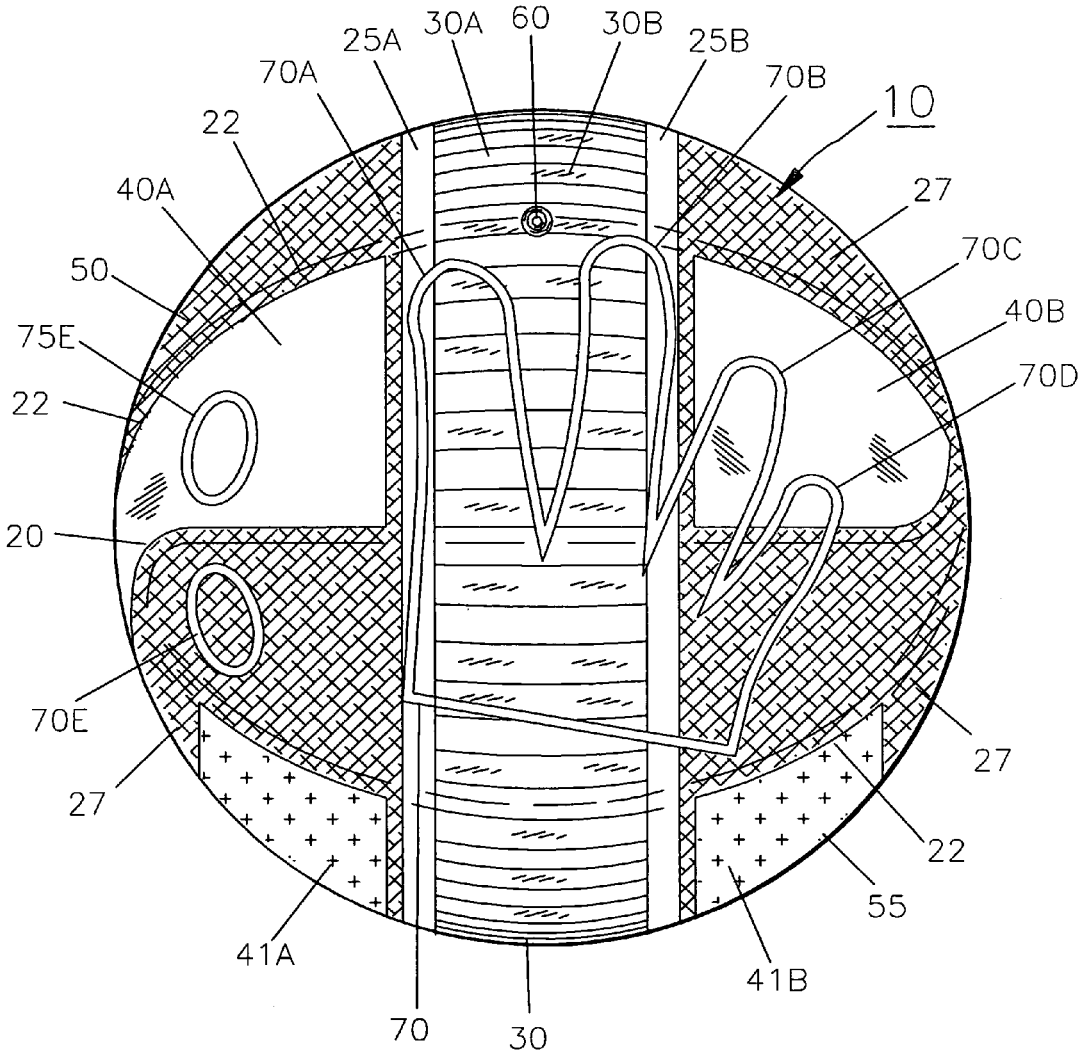
FIG. 1 is a front view of a basketball shooting aid constructed in accordance with the principles of the present invention, and in particular illustrating the first outlined hand displayed thereon.

In accordance with the present invention, a basketball shooting aid is disclosed. The basketball shooting aid designed to provide the athlete immediate visual feedback. Specifically, the basketball shooting aid visually informs the athlete as to the proper grip, the release of the shot and the arc in rotation of the basketball during flight. It will be noted in the drawings that the basketball shooting aid relates to a novel system and method of use in basketball shooting practice. In the broadest context, the basketball shooting aid consists of surface configurations, designs and colors with respect to each other so as to attain the desired objective.

FIGS. 1–6 illustrate a preferred embodiment of a basketball shooting aid 10 made in accordance with the present invention.

The body of the basketball 10 may be made following any of a number of procedures known in the art, having the components of prior art basketballs, including having a plurality of substantially elliptical and circular interconnected seams 20 forming substantially congruent panels 27 distributed orderly about the circumference of the basketball 10, and a center seam 22 that extends the circumference of the basketball 10. Such seams 20 and 22 are of substantially normal width and essentially of inelastic material such as nylon. The basketball 10 having displayed a first line 25A, and a second line 25B in parallel alignment with the first line 25A. The first line 25A and second line 25B extend the circumference of the basketball 10 in perpendicular relationship with the center seam 22. The first and second lines 25A and 25B forming an equatorial track 30 disposed there-between that likewise extends the circumference of the basketball 10.

Figure 2:
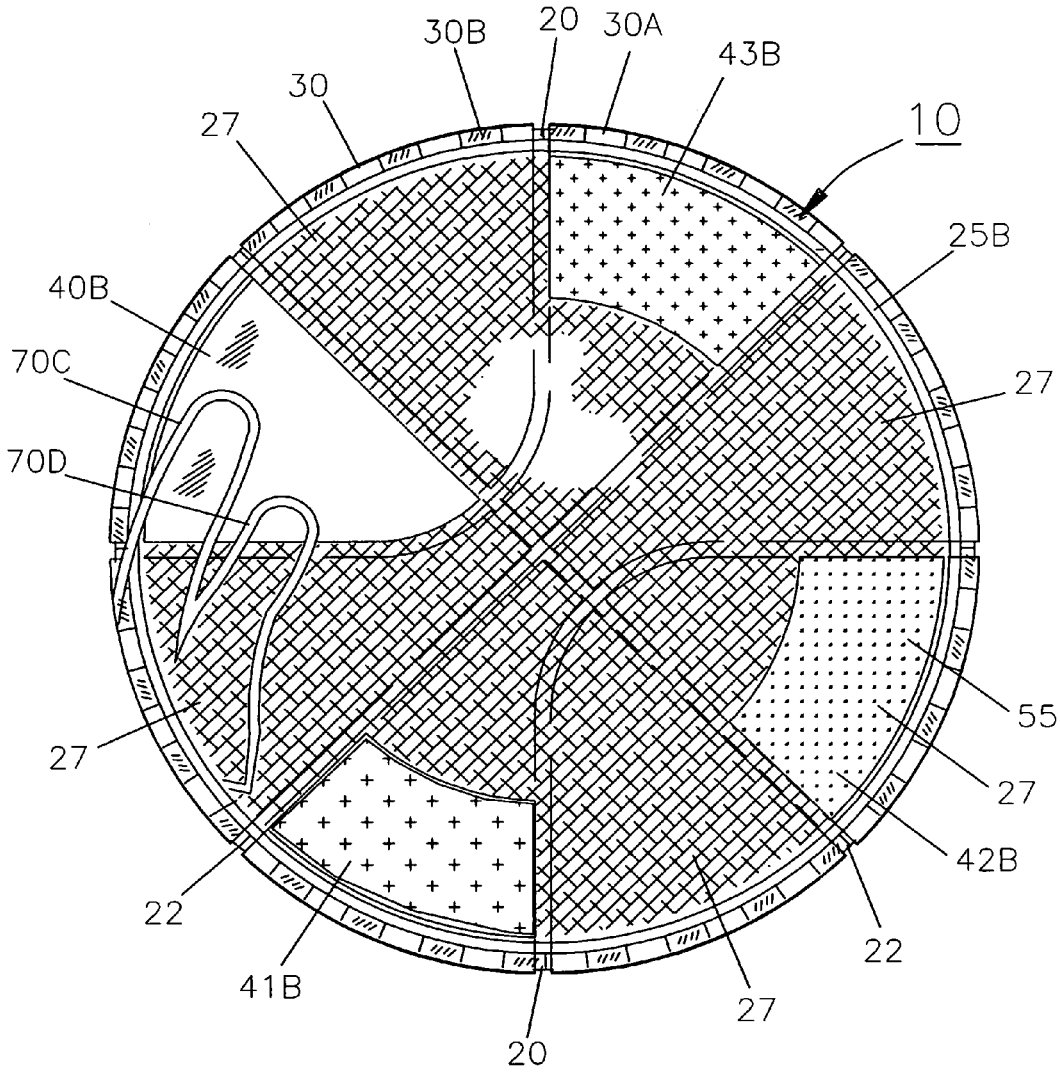
FIG. 2 is a side view of the basketball shooting aid of FIG. 1.
Figure 3:
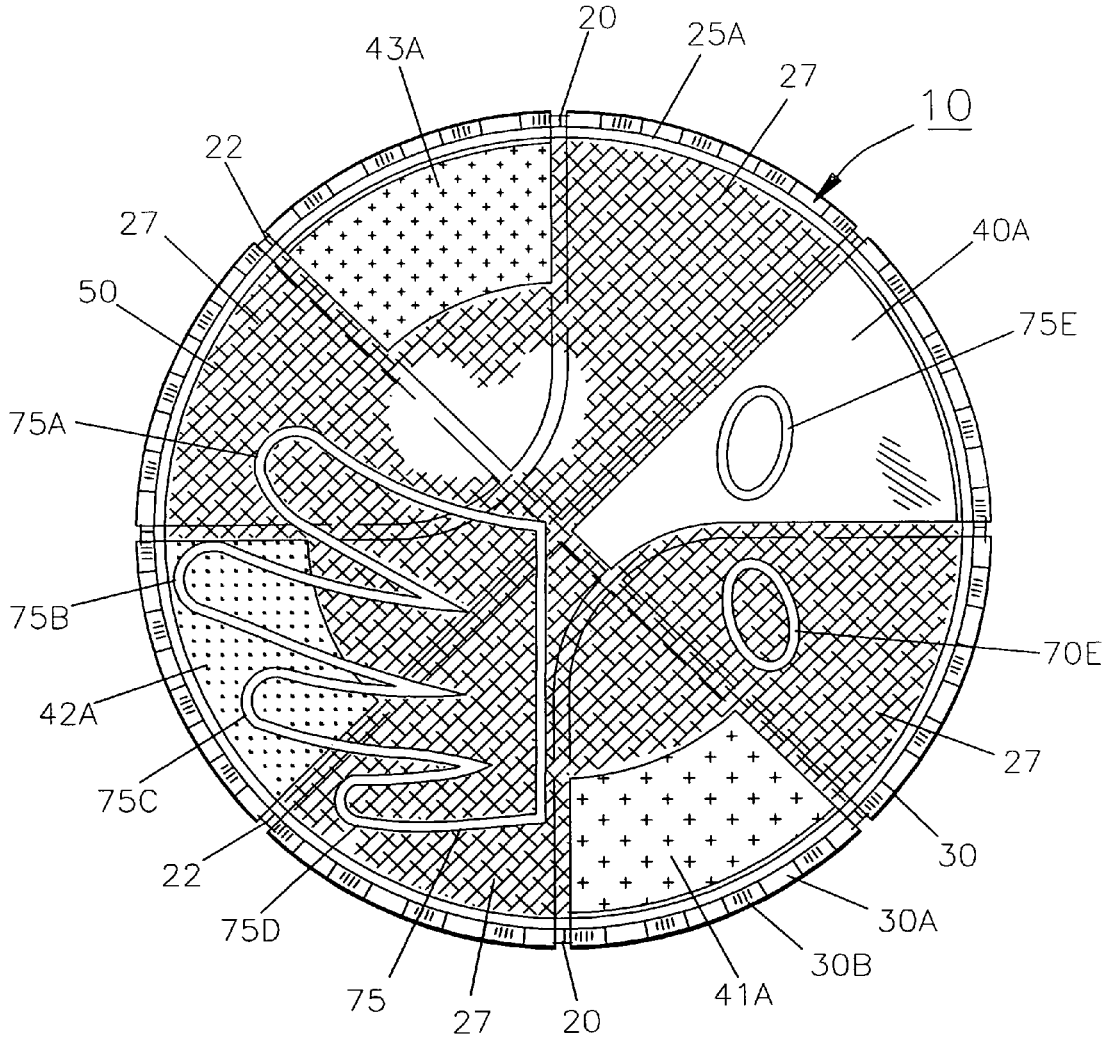
FIG. 3 is a side view of the basketball shooting aid of FIG. 1, in particular illustrating the second outlined hand displayed thereon.
Figure 4:
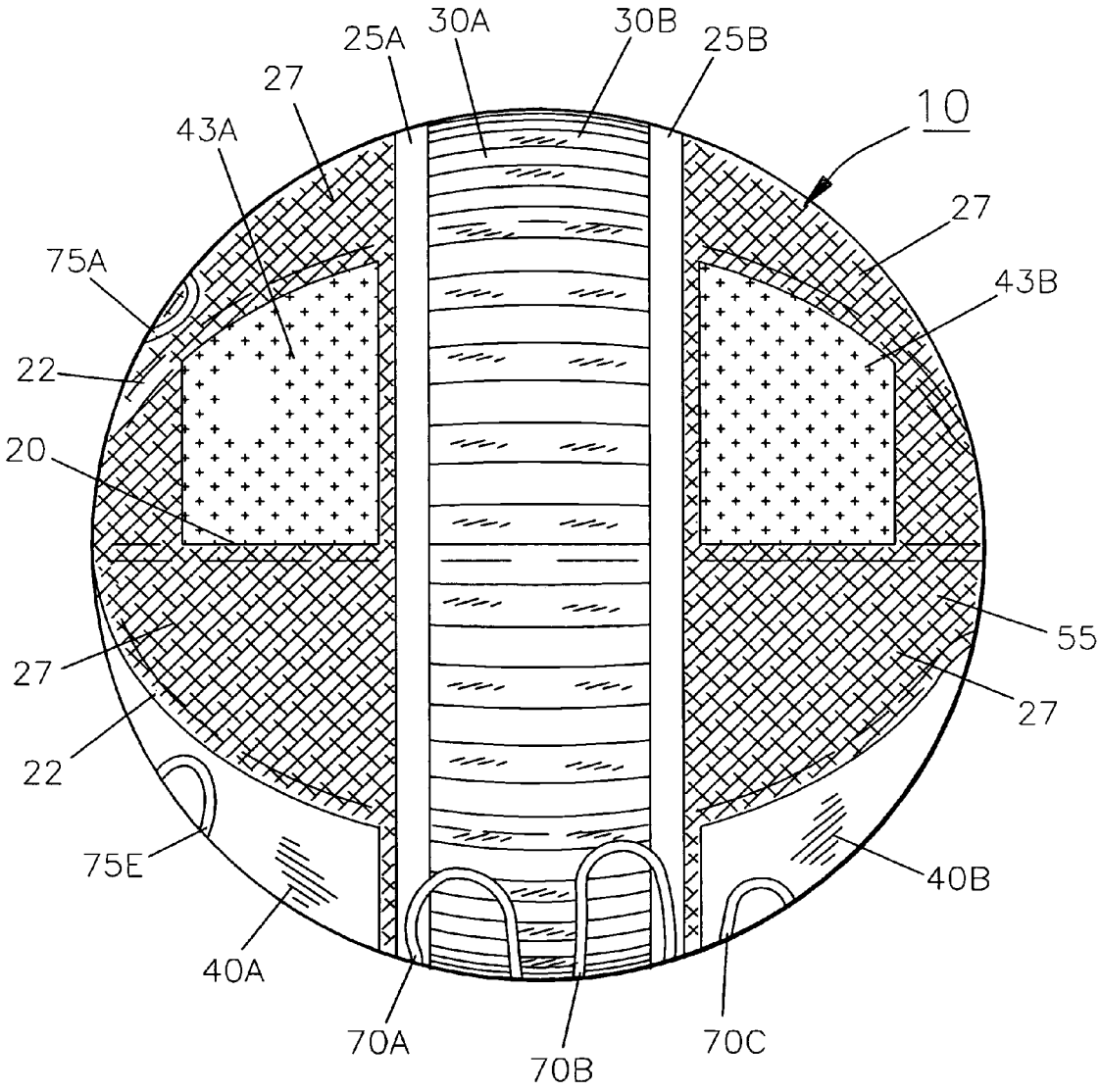
FIG. 4 is a front view of the basketball shooting aid of FIG. 1, in particular illustrating the equatorial track of the present invention.
Figure 5:
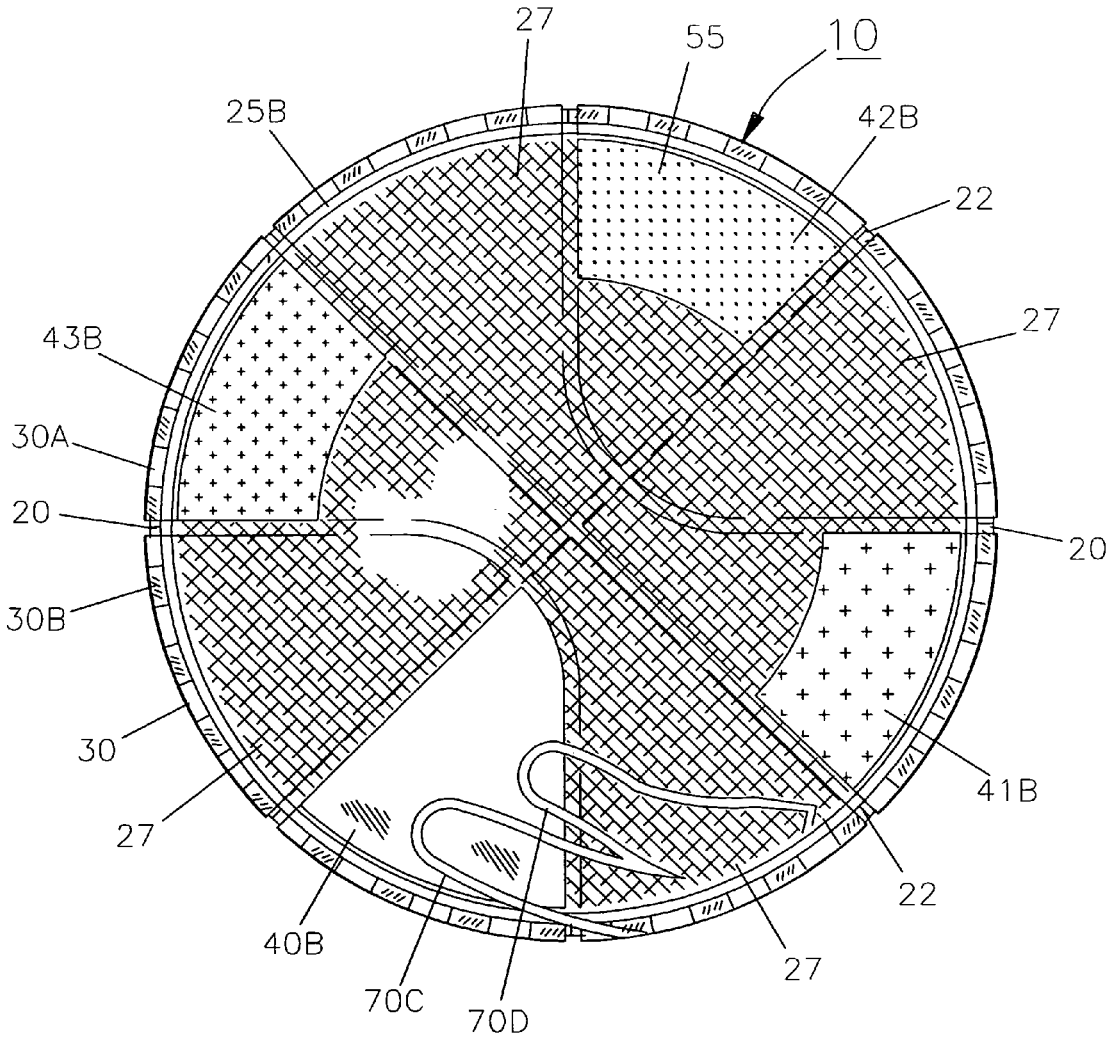
FIG. 5 illustrates a side view of the basketball shooting aid of FIG. 1.

The equatorial track 30 is defined by alternating color members 30A and 30B displayed thereon. The color members 30A and 30B having generally defined rectangular configurations disposed between the first line 25A and the second line 25B. In the preferred embodiment, the color member 30A is a dominant color such as bright red or orange, and color member 30B is a less dominant color such as yellow. In the preferred embodiment, the first line 25A and the second line 25B being displayed in the color white. As shown in FIGS. 2, 3 and 5, the color members 30A and 30B extend the circumference of the basketball 10. As best shown in FIGS. 1, 4, 6 and 7, the equatorial track 30 effectively partitioning the basketball 10 and forming a first hemispherical half 50 disposed on one side of the equatorial track 30 and a second hemispherical half 55 disposed on the opposite side of the equatorial track 30.

As best shown in FIG. 1 disposed within the first hemispherical half 50 and abutting the first line 25A are displayed color patches 40A, 41A, 42A and 43A, each of the color patches 40A, 41A, 42A and 43A selectively disposed within one of the panels 27. In the preferred embodiment, the patch 40A is displayed in the color white, and the patches 41A, 42A and 43A are displayed in any color except the color white or the selected colors of the alternating color members 30A and 30B.

Disposed within the second hemispherical half 55 and abutting the second line 25B are displayed color patches 40B, 41B, 42B and 43B, each of the color patches 40B, 41B, 42B and 43B selectively disposed within one of the panels 27. Further, the patches 40B, 41B, 42B and 43B are identical in color and configuration to the patches 40A, 41A, 42A and 43A, respectively. As will be further described, the surface configurations and colors of the present invention are so that the patch 40A is parallel to the patch 40B, the patch 41A is parallel to the patch 41B, the patch 42A is parallel to the patch 42B, and the patch 43A is parallel to the patch 43B.

As is known in the art, the basketball 10 further includes a needle valve opening (not shown). The needle valve opening of prior art and adapted to have the end of a needle valve inserted there into, and which is used for the introduction of air to the interior of the basketball 10 body. In the preferred embodiment, the needle valve opening is generally disposed on or near the center seam 22, and in particular, at an approximate location where the center seam 22 intersects with the equatorial track 30.

As described, the color patch 40A disposed within the first hemispherical half 50, and in abutting relationship with the first line 25A. The color patch 40B disposed within the second hemispherical half 55, and in abutting relationship with the second line 25B. The color patches 40A and 40B are on the same axis. Further, for best visibility as will be discussed, the color patches 40A and 40B having an elongated rectangular configuration.

As shown in the drawings, the color patch 41A disposed within the first hemispherical half 50 and selectively displayed within one of the panels 27 formed of the circular interconnected seam 20, and in abutting relationship with the first line 25A. Likewise, the color patch 41B disposed within the second hemispherical half 55 and selectively displayed within one of the panels 27 formed of the circular interconnected seam 20, and in abutting relationship with the second line 25B; the color patches 41A and 41B are on substantially the same axis. As best shown in FIG. 3, the color patch 41A in spaced apart relationship with the color patches 40A and 42A, and as best shown in FIG. 2, the color patch 41B in spaced apart relationship with the color patches 40B and 42B. Further, the color patches 41A and 41B having a substantially rectangular configuration.

The color patch 42A disposed within the first hemispherical half 50 and selectively displayed within one of the panels 27 formed of the circular interconnected seam 20, and in abutting relationship with the first line 25A. Likewise, the color patch 42B disposed within the second hemispherical half 55 and selectively displayed within one of the panels 27 formed of the circular interconnected seam 20, and in abutting relationship with the second line 25B; the color patches 42A and 42B are on substantially the same axis. The color patch 42A in spaced apart relationship with the color patches 41A and 43A, and the color patch 42B in spaced apart relationship with the color patches 41B and 43B. Further, the color patches 42A and 42B having a substantially rectangular configuration.

The color patch 43A disposed within the first hemispherical half 50 and selectively displayed within one of the panels 27 formed of the circular interconnected seam 20, and in abutting relationship with the first line 25A. Likewise, the color patch 43B disposed within the second hemispherical half 55 and selectively displayed within one of the panels 27 formed of the circular interconnected seam 20, and in abutting relationship with the second line 25B; the color patches 43A and 43B are on substantially the same axis. The color patch 43A in spaced apart relationship with the color patches 42A and 40A, and the color patch 43B in spaced apart relationship with the color patches 42B and 40B. Further, the color patches 43A and 43B having a substantially rectangular configuration.

The basketball 10 further includes a first outlined hand 70 preferably disposed slightly below the needle valve opening. The first outlined hand 70 having outlined fingers 70A, 70B, 70C and 70D, where the outlined finger 70A is positioned primarily on the first line 25A, and the outlined finger 70B is positioned primarily on the second line 25B, and the outlined fingers 70C and 70D are positioned in the second hemispherical half 55.

The basketball 10 further includes a second outlined hand 75 having outlined fingers 75A, 75B, 75C and 75D, the second outlined hand 75 disposed in the first hemispherical half 50.

As best shown in FIG. 1, immediately adjacent the first outlined hand 70 and between the first outlined hand 70 and the second outlined hand 75 is disposed a first outlined thumb-print 70E and a second outlined thumb-print 75E. The first outlined thumb-print 70E and the second outlined thumb-print 75E disposed in the first hemispherical half 50. In particular, the second outlined thumb-print 75E disposed within the panel 27 displaying the color patch 40A, and the first outlined thumb-print 70E disposed in the panel 27 immediately below the second outlined thumb-print 75E.

In use, the athlete places his shooting hand (not shown) in position over the first outlined hand 70 of the basketball 10 so that the athlete's fingers (not shown) are placed over the outlined fingers 70A, 70B, 70C and 70D of the basketball 10, and the athlete's thumb (not shown) of the athlete's shooting hand is positioned over the first outline thumb-print 70E. The athlete then places his non-shooting hand (not shown) in position over the second outlined hand 75 of the basketball 10 so that the athlete's fingers (not shown) are placed over the outlined fingers 75A, 75B, 75C and 75D of the basketball 10, and the athlete's thumb (not shown) of the athlete's non-shooting hand is positioned over the second outlined thumb-print 75E.

The key to the present invention is to provide immediate visual feedback to the athlete after each shot. Such visual feedback will immediately inform the athlete whether the proper technique was employed in the athlete's grip of the basketball 10, release of the basketball 10 during the shot, and the arc and rotation of the basketball 10 during flight.

Gripping the Ball.

The grip of the athlete's hands on the basketball is a crucial element of the shot. The Manuals state that the index and middle fingers of the shooting hand, the ones which propels the basketball, should be in the middle of the ball. The basketball 10 of the present invention informs the athlete of the proper location to grip the basketball. As described, the athlete places his shooting hand in position over the first outlined hand 70 of the basketball 10 so that the athlete's fingers are placed over the outlined fingers 70A, 70B, 70C and 70D of the basketball 10, and the athlete's thumb of the athlete's shooting hand is positioned over the first outlined thumb-print 70E. This insures that the athlete's shooting hand is in the middle of the ball, creating a good balanced grip.

The Manuals instruct that the ball should rest not in the palm of the athlete's shooting hand, but on the pads of the hands between the fingers and the palm. There should be enough space between the shooting hand and the ball to slip a pencil between the ball and the palm. This is accomplished with the present invention by concentrating on the athlete placing the athlete's fingers over the outlined fingers 70A, 70B, 70C and 70D of the basketball 10. As a result, the basketball 10 does not rest in the palm of the shooting hand, but on the pad of the athlete's shooting hand between the athlete's fingers and palm.

The Manuals describe the non-shooting hand as the off hand, guide hand, or balance hand. Athlete's should not use the off hand to propel the ball, but simply to balance it. In position, the fingers of the athlete's guide hand should point to the ceiling, and the athlete's thumb of the guide hand should point to the shooter's ear. The basketball 10 of the present invention informs the athlete of the proper location for the non-shooting hand.

The athlete places his non-shooting hand in position over the second outlined hand 75 of the basketball 10 so that the athlete's fingers are positioned over the outlined fingers 75A, 75B, 75C and 75D of the basketball 10, and the athlete's thumb of the athlete's non-shooting hand is positioned over the second outlined thumb-print 75E. This insures that the athlete's non-shooting hand is in the proper position on the basketball 10 and in proper relationship with the positioning of the shooting hand.

Releasing the Ball.

The release of the shot is extremely important. The Manuals agree that the basketball during the shot should roll off the index finger and the middle finger of the athlete's shooting hand. These two fingers should be the last things to touch the basketball. This technique insures the proper backspin on the ball, creating a softness to the shot. The basketball 10 of the present invention gives the athlete immediate feedback as to whether the release was proper for each shot.

Once the athlete properly grips the basketball 10 as discussed above, the athlete brings the basketball 10 upwards to shoot. At this point, the equatorial track 30 should be in visual alignment with the basketball goal. When the athlete releases the shot, the athlete is able to view the flight of the basketball 10, and specifically view the rotation and movement, if any, of the color members 30A and 30B within the equatorial track 30. If the technique and release of the basketball 10 was performed properly, the equatorial track 30 will remain aligned with the basketball goal during the flight of the basketball 10 (as shown in FIGS. 6–7), and proper rotation of the basketball 10 during flight is referenced by the rotation of the color members 30A and 30B.

Figure 6:
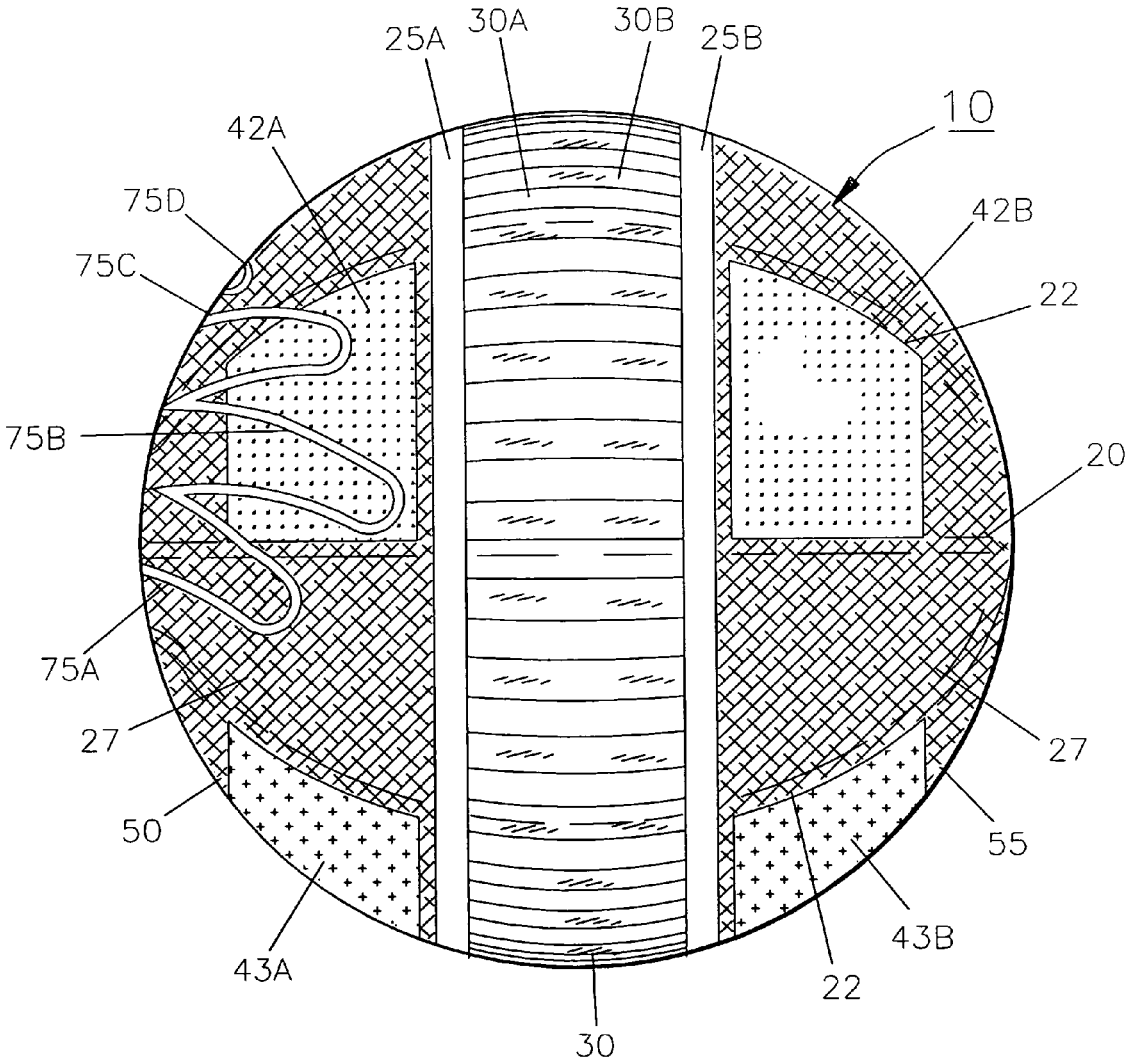
FIG. 6 is a front view of the basketball shooting aid of FIG. 1, in particular illustrating the equatorial track of the present invention.
Figure 7:
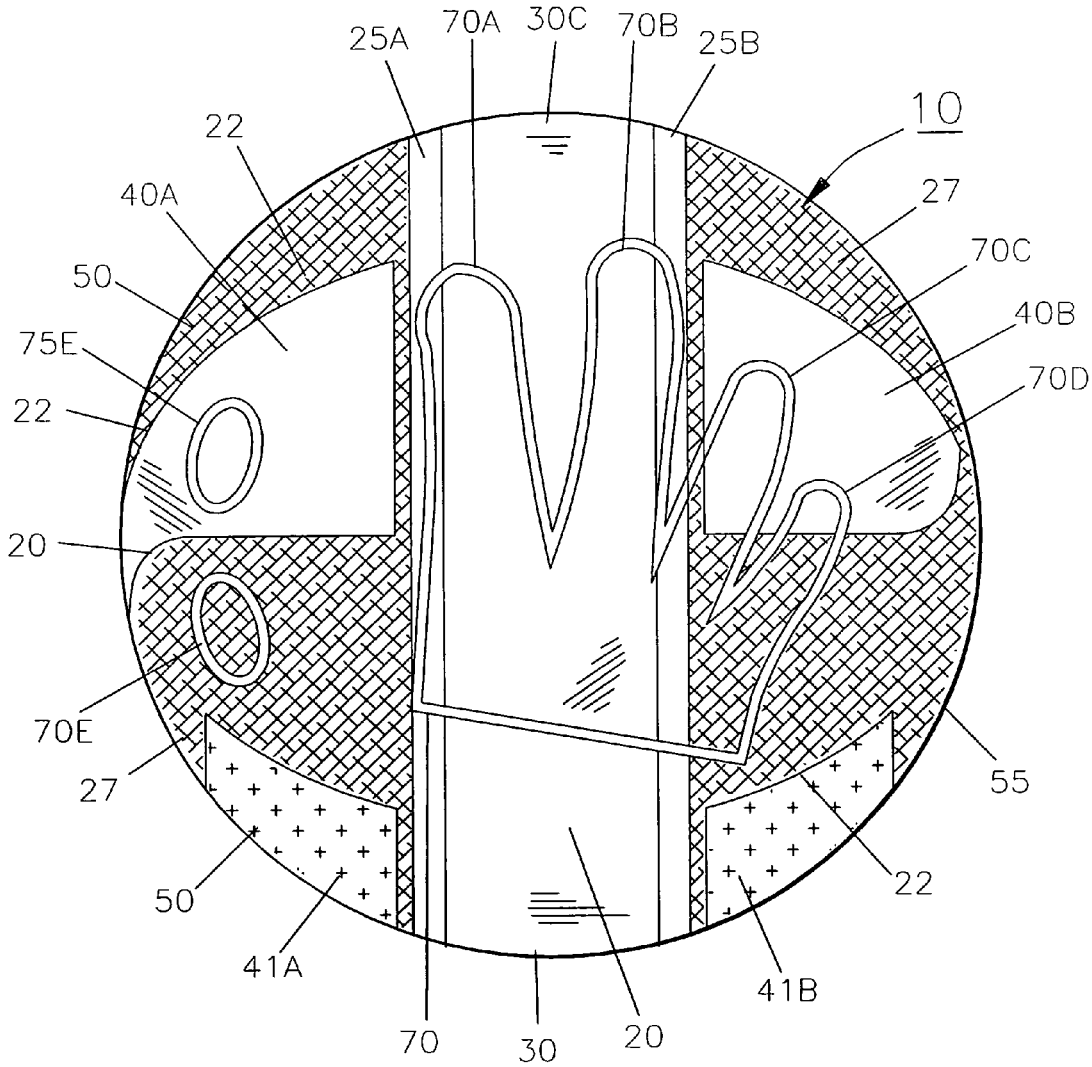
FIG. 7 is a front view of the basketball shooting aid of FIG. 1, and in particular illustrates the basketball shooting aid in flight.
Figure 9:
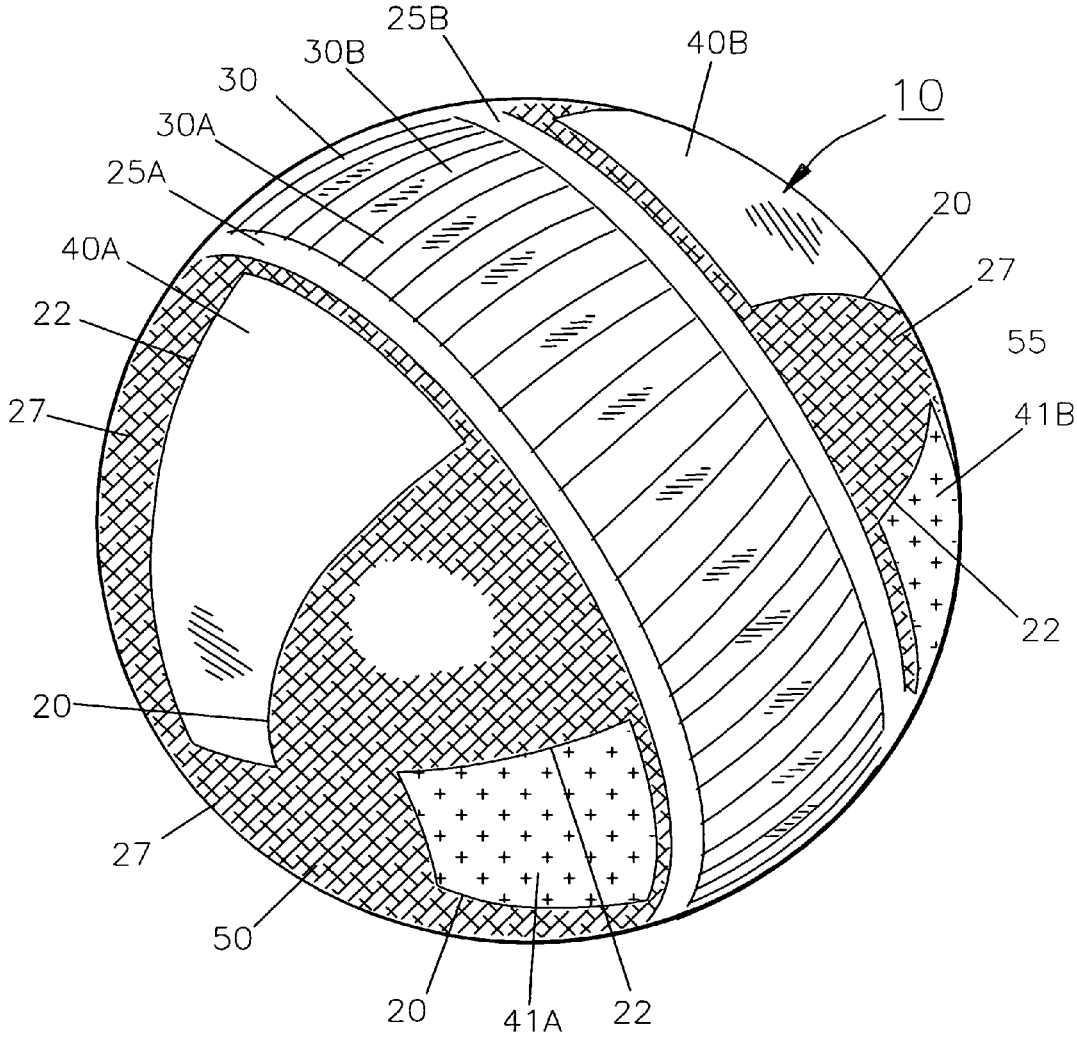
FIG. 9 is a perspective view of the basketball shooting aid of FIG. 1, and in particular illustrates the basketball shooting aid in flight.

If the athlete is able to view the individual color members 30A and 30B during the flight of the basketball 10 (as shown in FIGS. 6 and 9), the athlete failed to place proper back spin on the basketball 10. The athlete would then need to further work on either the proper grip, or, releasing the basketball 10, or both, as discussed above.

Proper release is confirmed using the basketball 10 when due to the rotation of the basketball 10 after release, the color members 30A and 30B rotate with such velocity that the athlete no longer sees the color members 30A and 30B individually, but sees a substantially continuous new color 30C (shown in FIGS. 7 and 8) caused by the visual blending of the rotating color members 30A and 30B. In short, as a result of such rotation, the equatorial track 30 appears as a solid color during flight namely the new color 30C. Again, the new color 30C being the visual result of the visual blending of color members 30A and 30B during proper flight rotation of the basketball 10.

Figure 8:
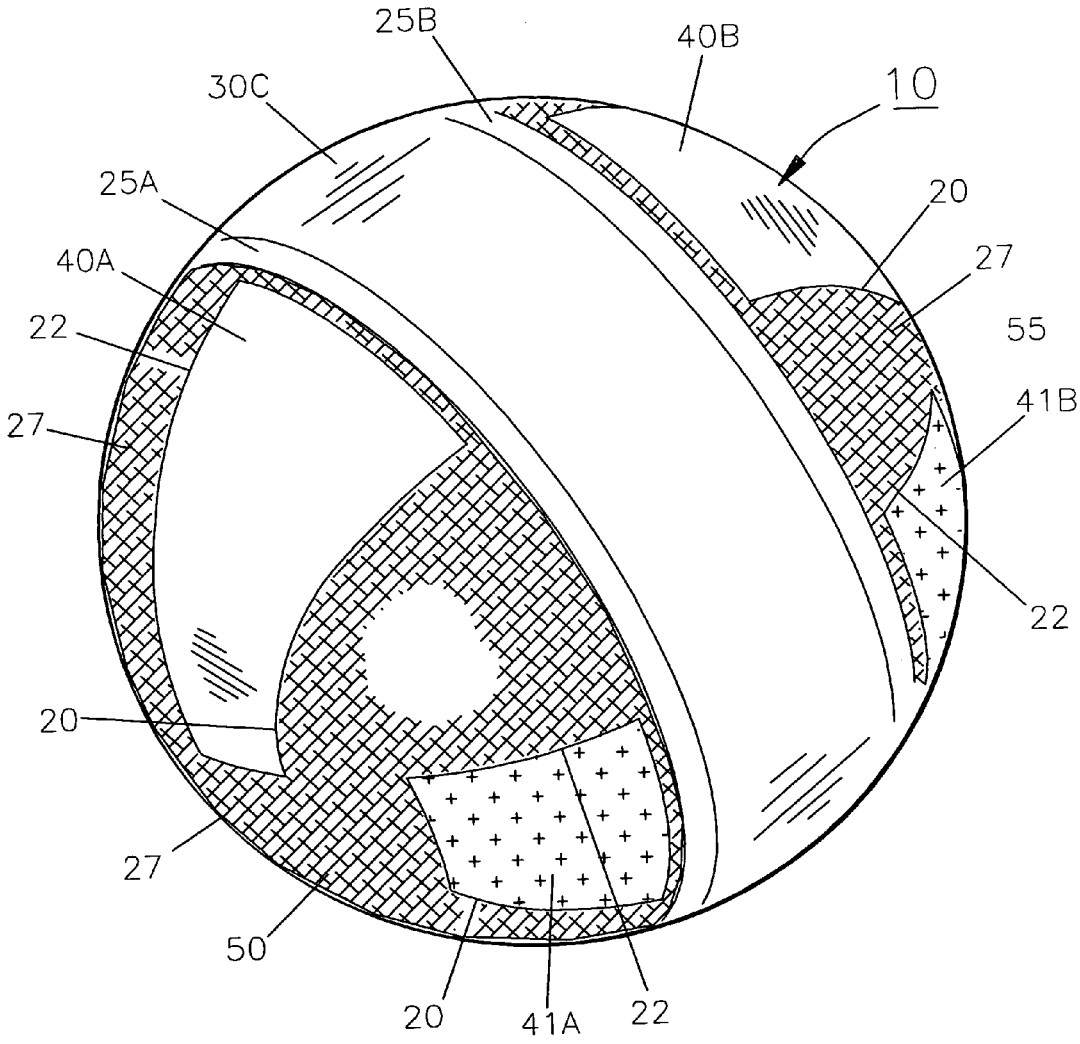
FIG. 8 is a perspective view of the basketball shooting aid of FIG. 1, and in particular illustrates the basketball shooting aid in flight.

If the equatorial track 30 does not remain in alignment with the basketball goal during flight (as shown in FIGS. 8–9), the athlete is immediately given feedback by viewing the angle of the equatorial track 30 during flight. The athlete would then need to further work on either the proper grip, or releasing the basketball 10, or both, as discussed above.

The Arc on the Shot.

The arc on the shot is also a crucial element of the shot. The Manuals state that with too much arc, the athlete may be expending too much energy. Without enough arc, the shot will be too flat. Proper arc on the ball creates a softness to the shot. The basketball 10 of the present invention gives the athlete immediate feedback as to whether the arc on each shot was proper.

Once the athlete has the proper grip on the basketball 10 as discussed above, and has the equatorial track 30 aligned with the basketball goal as further discussed above, the elongated white color patches 40A and 40B will be facing the athlete (as shown in FIG. 1). Once the shot is released, proper rotation as discussed above will cause the color patches 40A and 40B (as well as the remaining color patches 41A, 41B, 42A, 42B, and 43A, 43B) to rotate while the basketball 10 is in flight. Counting the number of times the elongated white color patches 40A and 40B rotate during the flight of the basketball 10, informs the athlete how many times the basketball 10 rotated fully in flight.

The inventor has determined that from the free throw line, which is 15 feet from the goal, the basketball 10 should rotate between 1½–2 full rotations. A proper arc of 1½–2 rotations of the basketball 10, would result in the athlete seeing the white color patches 40A and 40B once and seeing the color patches 41A and 41B and 42A and 42B twice each during the flight of the shot. Seeing the white color patches 40A and 40B twice during the flight of the shot informs the athlete that the basketball 10 had two full rotations during flight. If the basketball 10 rotates more than two full rotations, meaning the ball 10 is still in flight after the athlete has seen the white color patches two times, this informs the athlete there is too much arc on the ball, and the shooter is expending too much energy. To the contrary, if the athlete views less than 1½–2 rotations during the flight of the shot, this informs the athlete that the shot was too flat.

The key to the present invention is to provide immediate visual feedback to the athlete after each shot. Such visual feedback as described above, will immediately inform the athlete whether the proper technique was employed in the athlete's grip of the basketball 10, release of the basketball 10 during the shot, and the arc and rotation of the basketball 10 during flight.

Although the description above contains many specificities, these should not be construed as limiting the scope of the invention but as merely providing illustrations of a presently preferred embodiment of this invention. For example, while the drawings illustrate the basketball 10 for an athlete whose dominant shooting hand is the right hand, it should be obvious that the basketball 10 of the present invention is useful to an athlete whose dominant shooting hand is the left hand.

For a left handed shooter, the displayed outlined hands 70 and 75 and outlined thumb prints 70E and 75E would be adjustably displayed according to the teachings herein, so that once the athlete properly grips the basketball 10, and the athlete brings the basketball 10 upwards to shoot, the equatorial track 30 is in visual alignment with the basketball goal. As previously discussed, when the athlete releases the shot, the athlete is able to view the flight of the basketball 10, and specifically view the rotation and movement, if any, of the color members 30A and 30B within the equatorial track 30. If the technique and release of the basketball 10 was performed properly, the equatorial track 30 will remain aligned with the basketball goal during the flight of the basketball 10 (as shown in FIGS. 6–7), and proper rotation of the basketball 10 during flight is referenced by the rotation of the color members 30A and 30B.

In the preferred embodiment, the first line 25A, second line 25B, equatorial track 30, and color patches 40A, 41A, 42A, 43A, 40B, 41B, 42B, and 43B are printed on the surface of the basketball 10. Alternatively, said first line, second line, equatorial track and color patches may be appliqués applied to the surface of the basketball 10.

Thus the scope of the invention should be determined by the appended claims in the formal application and their legal equivalents rather than by the examples given.

I claim:

1. A method of training a user to shoot a basketball, the method comprising:

providing a basketball, said basketball including:

a first line and a second line, an equatorial track disposed between said first and second lines, said equatorial track extending a circumference of said basketball and defining a first hemispherical half and a second hemispherical half, wherein said equatorial track having a width substantially wider than said basketball's center seam, and wherein said first line and said second line having a width wider than said basketball's center seam and narrower than the equatorial track, alternating color members disposed between said first and second lines, said alternating color members comprising a plurality of first rectangular members displaying a first color and a plurality of second rectangular members displaying a second color, a first outlined hand on said basketball, wherein a first portion of said first outlined hand is positioned primarily on said first line and a second portion of said first outlined hand is positioned primarily on said second line, a first patch on an axis and within the first hemispherical half adjacent to said first line, a second patch on said axis and within the second hemispherical half adjacent to said second line, wherein said first patch and said second patch are both of a third color;

positioning the user's shooting hand on said first outlined hand;

said user raising said basketball with said user's shooting and non-shooting hands;

aligning the equatorial track with a basketball goal;

shooting the basketball toward the basketball goal so that the equatorial track remains in alignment with the goal;

observing flashes of color of said third color positioned on either side of said equatorial track and determining the number of full and partial rotations completed by said basketball in flight; and observing a fourth color created by a visual blending of said first and second colors positioned in said equatorial track to determine the proper alignment of the basketball in flight.

2. The method of claim 1, wherein said basketball further includes a second outlined hand.

3. The method of claim 1, wherein said first portion of said first outlined hand is an index finger.

4. The method of claim 3, wherein said second portion of said first outlined hand is a middle finger.

* * * * *